US005753179A

United States Patent [19]

Nishizawa et al.

[11] Patent Number: 5,753,179

[45] Date of Patent: May 19, 1998

[54] STEELS FOR EXHAUST VALVES HAVING IMPROVED FATIGUE STRENGTH AT HIGH TEMPERATURE, CORROSION RESISTANCE AT ROOM AND HIGHER TEMPERATURES AND OXIDATION RESISTANCE

[75] Inventors: Yoshitaka Nishizawa, Sendai; Akihiro Hamada; Shinichi Umino, both of Fujisawa, all of Japan

[73] Assignees: Tohoku Steel Co., Ltd., Miyagi Pref.; Fuji Oozx Inc., Kanagawa Pref., both of Japan

[21] Appl. No.: 717,456

[22] Filed: Sep. 20, 1996

[30] Foreign Application Priority Data

May 20, 1996 [JP] Japan ..... 8-124606

[51] Int. Cl.[6] ..... C22C 38/42; C22C 38/44

[52] U.S. Cl. ..... 420/57; 420/58; 420/59

[58] Field of Search ..... 148/327; 420/57, 420/58, 59

[56] References Cited

U.S. PATENT DOCUMENTS 3,401,036 9/1968 Dulis et al. ..... 420/57

FOREIGN PATENT DOCUMENTS 62-13428 3/1987 Japan .
3-177543 8/1991 Japan .
6-17198 1/1994 Japan .

*Primary Examiner*—Deborah Yee
*Attorney, Agent, or Firm*—Young & Thompson

[57] ABSTRACT

A steel for exhaust valves comprises C: 0.50–0.65 wt %, Si: 0.1–0.3 wt %, Mn: 5.0–8.0 wt %, Cr: 22.0–24.0 wt %, Ni: 5.0–7.0 wt %, Cu: 0.4–1.0 wt %, Mo: 0.4–2.0 wt %, W: 0.4–2.0 wt %, Nb: 0.4–2.0 wt %, Ti: 0.1–0.3 wt %, N: 0.35–0.50 wt %, sol. Al: 0.005–0.03 wt %, B: 0.001–0.01 wt %, provided that (Cu+Ni): 5.8–7.6 wt %, and the balance being Fe and inevitable impurities and has excellent high-temperature strength, corrosion resistance at room and higher temperatures and oxidation resistance.

3 Claims, 3 Drawing Sheets

STEELS FOR EXHAUST VALVES HAVING IMPROVED FATIGUE STRENGTH AT HIGH TEMPERATURE, CORROSION RESISTANCE AT ROOM AND HIGHER TEMPERATURES AND OXIDATION RESISTANCE

BACKGROUND OF THE INVENTION

1. Field of the Invention

This invention relates to a steel suitable for use in an exhaust valve of an internal combustion engine, particularly an automobile engine and having improved fatigue strength at a high temperature, corrosion resistance at room and higher temperatures and oxidation resistance.

2. Description of Related Art

Recently, automobile engines tend to become more high-performance and hence it is demanded to have a higher thermal efficiency and higher power. As a result, the working temperature of the exhaust valve used in the engine rises above 800° C.

As a material for the exhaust valve of the automobile engine, there have been mostly used high-chromium, high-manganese iron-based alloys such as 21–2N, 21-4N and the like (JIS SUH35 and so on). However, such steel materials have no margin of the high-temperature strength, so that they are difficult to be put into practical use at the above high working temperature.

As a substitute for 21–2N and 21–4N, there have been developed high-Ni alloys such as NCF 751 and the like, and steel materials containing a high concentration of a refractory metal such as Mo, W, V, Nb or the like, but they do not come to possess both the strength and the resistance to sulfide and lead oxide corrosion. For example, the high Ni alloys such as NCF 751 and the like have no great difference from 21–4N steels as to fatigue strength above 850° C., and have inversely a problem that the resistance to sulfide corrosion at high temperature is poor.

In order to solve the above problems, the inventors have previously developed steels for exhaust valves having high hot fatigue strength and excellent oxidation resistance, corrosion resistance and creep properties by the adjustment of C and N contents, the reduction of Mn, Mo and Nb and the increase of Ni and Cr and disclosed in JP-A-3-177543.

Such a steel for exhaust valves is largely suitable as an exhaust valve material for high-performance engine because the high-temperature strength, corrosion resistance at higher temperature and oxidation resistance are highly improved.

However, it has been confirmed that the steel for exhaust valves disclosed in JP-A-3-177543 has somewhat a problem as to corrosion resistance at room temperature, particularly the resistance to sulfide corrosion at room temperature.

When the corrosion resistance at room temperature is poor, there is a problem that intergranular corrosion resulting from combustion gas, particularly sulfur-containing compounds in combustion gas of diesel engines proceeds and the fatigue strength unavoidably lowers, so that the corrosion resistance at room temperature cannot be ignored as a property of a material for an exhaust gas of a high-performance engine.

SUMMARY OF THE INVENTION

It is, therefore, an object of the invention to favorably solve the aforementioned problems and to provide a steel for an exhaust valve having not only excellent fatigue strength and corrosion resistance at higher temperature and oxidation resistance but also excellent corrosion resistance at room temperature, and being cheap and optimum as a material for high-performance engines.

The inventors have made various studies in order to achieve the above object and found that the corrosion resistance at room temperature is advantageously improved without the degradation of properties such as corrosion resistance at higher temperature and the like by reducing the amount of Ni and adding an appropriate amount of Cu and as a result the invention has been accomplished.

According to the invention, there is the provision of a steel for exhaust valves having excellent fatigue strength at a high temperature, corrosion resistance at room and higher temperatures and oxidation resistance, comprising C: 0.50–0.65 wt %, Si: 0.1–0.3 wt %, Mn: 5.0–8.0 wt %, Cr: 22.0–24.0 wt %, Ni: 5.0–7.0 wt %, Cu: 0.4–1.0 wt %, Mo: 0.4–2.0 wt %, W: 0.4–2.0 wt %, Nb: 0.4–2.0 wt %, Ti: 0.1–0.3 wt %, N: 0.35–0.50 wt %, sol. Al: 0.005–0.03 wt %, B: 0.001–0.01 wt %, provided that (Cu+Ni): 5.8–7.6 wt %, and the balance being Fe and inevitable impurities.

In order to improve the high-temperature strength, it is more preferable that the chemical composition of the steel is so adjusted that a ratio of C+N to carbonitride forming elements Cr, Mo, W, Nb and Ti satisfies the following relationship:

$$(C+N)/\{(Cr-22)+Mo+W+Nb+Ti\}=0.28-0.46$$

BRIEF DESCRIPTION OF THE DRAWINGS

The invention will be described with reference to the accompanying drawings, wherein.

DESCRIPTION OF PREFERRED EMBODIMENTS

Figure 1:
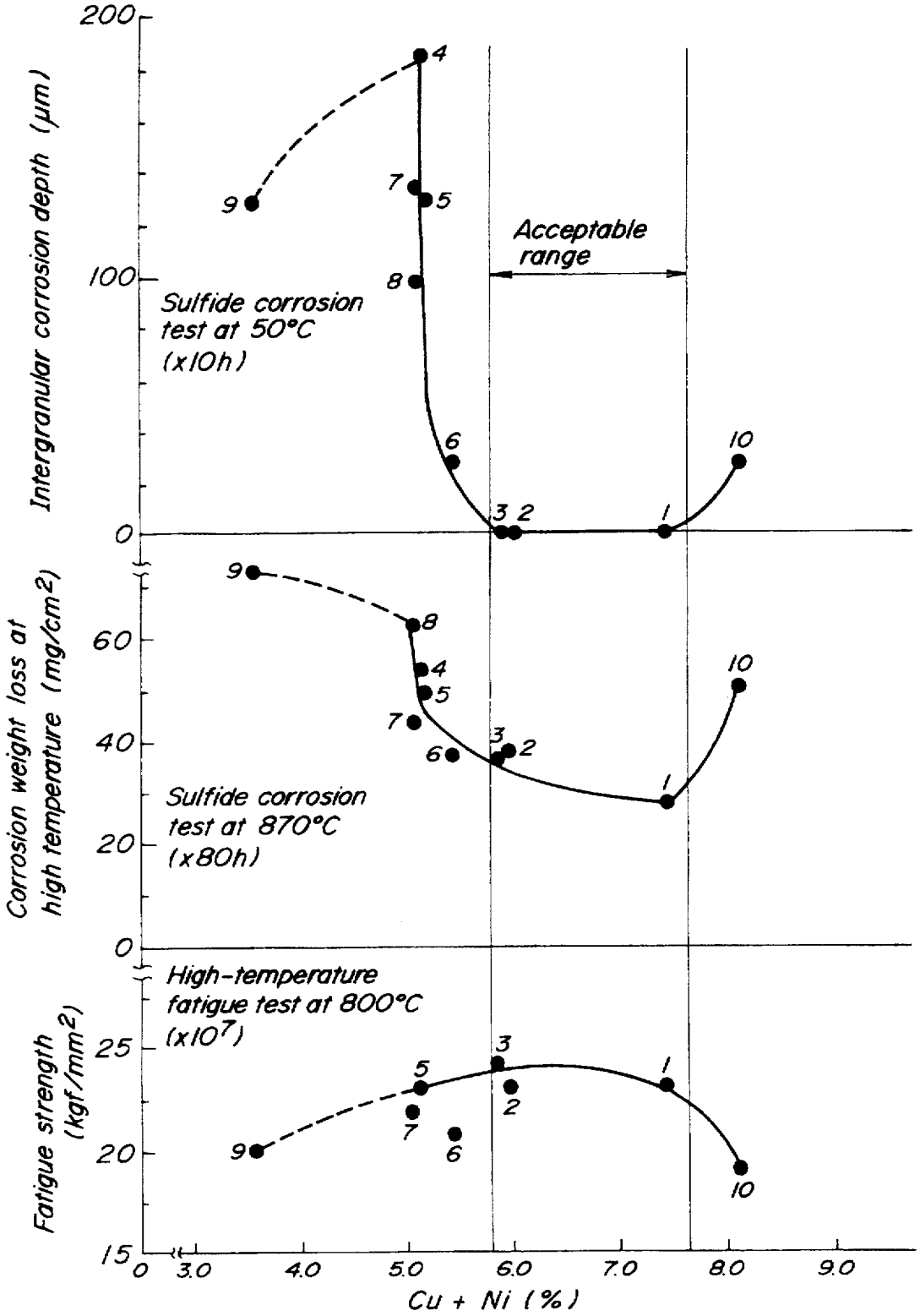
FIG. 1 is a graph showing a relation of (Cu+Ni) amount to intergranular corrosion depth, corrosion weight loss at higher temperature and fatigue strength.

The reason why the chemical composition is limited to the above range defined in the invention is due to the following facts.

C: 0.50–0.65 wt %

C is an element essential for not only stabilizing austenite structure but also ensuring strengths at room and higher temperatures through the formation and precipitation of carbonitride. In view of the balance of alloying elements added in the alloy system according to the invention, when the C amount is less than 0.50 wt %, the strength is insufficient, while when it exceeds 0.65 wt %, the toughness lowers and hot and cold working becomes difficult, so that the C amount is limited to a range of 0.50–0.65 wt %.

Si: 0.1–0.3 wt %

Si not only acts as a deoxidizing agent but also is useful as an element for improving the oxidation resistance. However, when the Si amount is less than 0.1 wt %, the addition effect is poor, while when it exceeds 0.3 wt %, the resistance to lead oxide corrosion is degraded, so that the amount is limited to a range of 0.1–0.3 wt %.

Mn: 5.0–8.0 wt %

Mn is an element useful for promoting the stabilization of austenite structure together with Ni, C and N. Further, it is an element useful for improving the resistance to sulfide corrosion. In order to develop these effects, it is necessary to add Mn in an amount of at least 5.0 wt %, but when it exceeds 8.0 wt %, the degradation of oxidation resistance is caused, so that the Mn amount is limited to a range of 5.0–8.0 wt %.

Cr: 22.0–24.0 wt %

Cr is required to be at least 22.0 wt % in order to ensure the heat resistance, oxidation resistance and corrosion resistance and increase the solute amount of N. However, when the amount is too large, σ-phase is formed to lower the toughness to thereby degrade the ductility, so that the Cr amount is limited to a range of 22.0–24.0 wt %.

Ni: 5.0–7.0 wt %

Ni is an austenite forming element and is important for stabilizing the structure at room temperature and is also essential for improving the corrosion resistance and heat resistance. For this purpose, the amount is required to be at least 5.0 wt %, but when it exceeds 7.0 wt %, the effect of improving the heat resistance and corrosion resistance is small and the cost becomes rather higher, so that the Ni amount is limited to a range of 5.0–7.0 wt %.

Cu: 0.4–1.0 wt %

Cu is a particularly important element in the invention and effectively contributes to improving the resistance to sulfide corrosion at not only room temperature but also higher temperature. Furthermore, it effectively contributes to the improvement of the high-temperature strength through the precipitation of fine Cu compound. In order to obtain such effects, it is required to be at least 0.4 wt %, but when it exceeds 1.0 wt %, the effect of improving the corrosion resistance and the high-temperature strength is saturated and the characteristics such as hot workability or the like and the oxidation resistance are inversely degraded, so that the Cu amount is limited to a range of 0.4–1.0 wt %.

Moreover, the amount of Cu+Ni is important for improving not only the resistance to sulfide corrosion at room temperature but also the resistance to sulfide corrosion at higher temperature and fatigue strength. As shown in FIG. 1, it is important that the total amount of Cu and Ni is restricted to a range of 5.8–7.6 wt % for obtaining good results on all of these properties.

Mo: 0.4–2.0 wt %

Mo is soluted in a base metal to improve the corrosion resistance and the high-temperature strength and also forms a carbide to develop an effect of improving the high-temperature strength. When the amount is less than 0.4 wt %, the addition effect is poor, while when it exceeds 2.0 wt %, there is no great difference in the high-temperature properties and the cost becomes rather higher, so that the Mo amount is limited to a range of 0.4–2.0 wt %.

W: 0.4–2.0 wt %

W is an element useful for improving the high-temperature strength through solid solution strengthening. This effect is observed when the W amount is not less than 0.4 wt %. However, when it exceeds 2.0 wt %, the improving effect is unchanged, so that the W amount is limited to a range of 0.4–2.0 wt %.

Nb: 0.4–2.0 wt %

Nb forms a stable carbonitride at a high temperature and hence contributes to effectively control the coarsening of crystal grains at a high temperature and prevent the lowering of the strength. This effect is observed when the Nb amount is not less than 0.4 wt %, but the addition exceeding 2.0 wt % decreases the C concentration in the base metal to lower the hardness, so that the Nb amount is limited to a range of 0.4–2.0 wt %.

Ti: 0.1–0.3 wt %

Ti is an element more stably forming carbide, nitride or oxide as compared with Nb and effectively contributes to form fine structure of steel ingots and prevent the coarsening of crystal grains upon heating at a high temperature. As a result, Ti is effective for improving the high-temperature strength through hot working at higher temperature and solid solution strengthening treatment. Furthermore, the C concentration in the base metal is increased by preferential precipitation of Ti carbonitride, which contributes to improving the corrosion resistance.

In order to obtain the above effects, it is required to add Ti in an amount of at least 0.1 wt %, but the excessive addition brings about the degradation of the high-temperature strength due to the formation of stable carbonitride together with Nb at a high temperature for fixation of C and N, so that the Ti amount is limited to a range of 0.1–0.3 wt %.

N: 0.35–0.50 wt %

N is an element useful for forming Cr carbonitride together with C to attempt the precipitation strengthening. When the N amount is less than 0.35 wt %, the addition effect is poor, while when it exceeds 0.50 wt %, the hot and cold workabilities and weldability are degraded, so that the N amount is limited to a range of 0.35–0.50 wt %.

sol. Al: 0.005–0.03 wt %

Al is a strong deoxidizing element and is an element useful for reducing non-metallic inclusion to improve the hot workability (from blooming to valve shaping). When the amount is less than 0.005 wt %, oxides discharged from a refractory in a melting furnace, alloying source or the like can not be removed, while when it exceeds 0.03 wt %, atmospheric pollution is apt to be caused in the ingot forming or the like, so that the sol. Al amount is limited to a range of 0.005–0.03 wt %.

B: 0.001–0.01 wt %

B is an element useful for strengthening austenite grain boundaries to improve the hot workability, high-temperature strength and creep property. When the amount is less than 0.001 wt %, the addition effect is poor, while when it exceeds 0.01 wt %, the agglomeration is caused in the crystal grain boundary to degrade the hot workability and lower the high-temperature strength, so that the B amount is limited to a range of 0.001–0.01 wt %.

Although the above is described with respect to the chemical composition of the essential components, it is preferable that a ratio of C and N amounts to amounts of carbonitride forming elements such as Cr, Mo, W, Nb and Ti in the above chemical composition is restricted to a given range in order further to improve the high-temperature strength.

Figure 2:
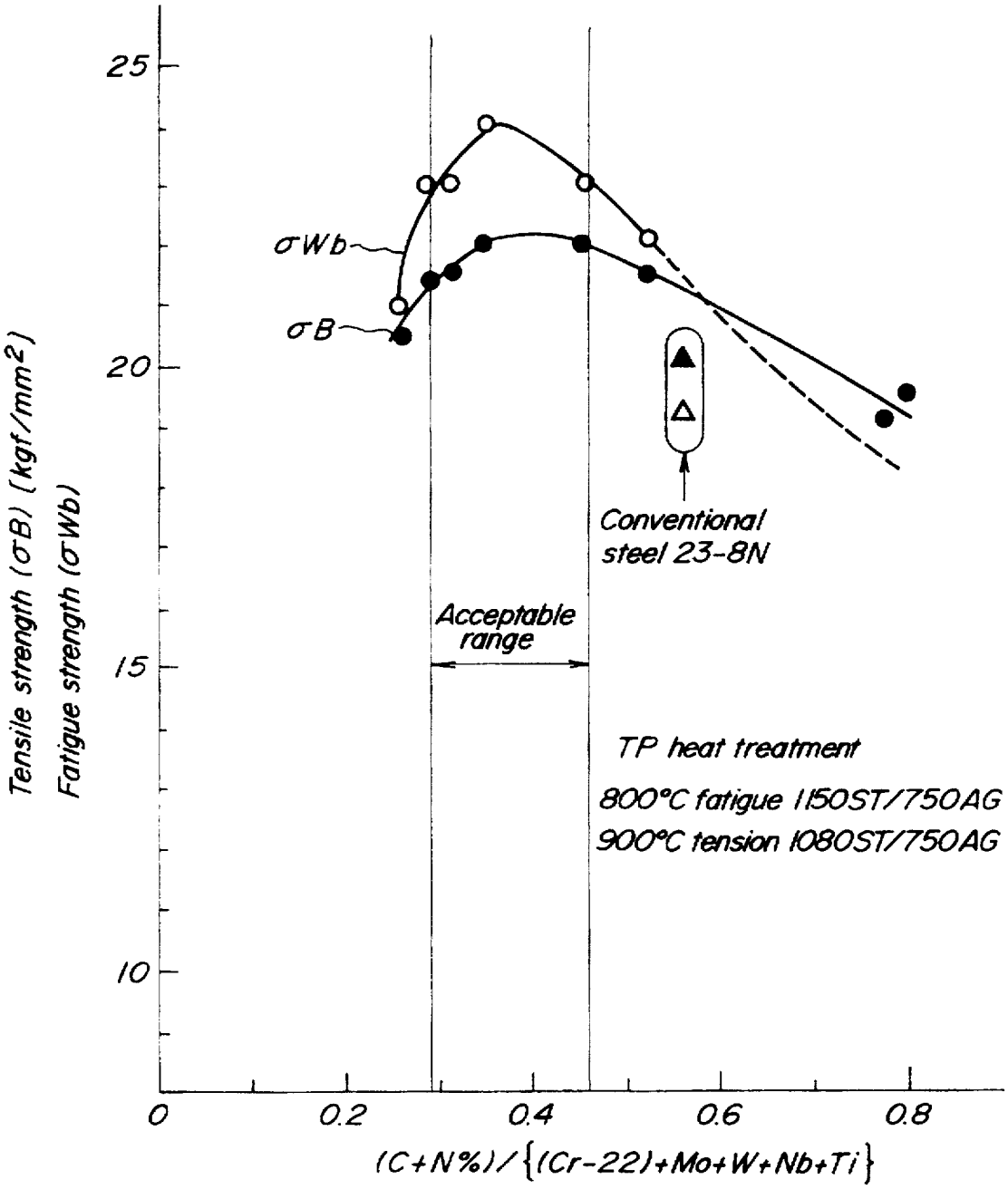
FIG. 2 is a graph showing a relation of (C+N)/{(Cr-22)+Mo+W+Nb+Ti} ratio to fatigue strength and tensile strength at higher temperature.

In FIG. 2 are shown results of studies of the influence of (C+N)/(Cr+Mo+W+Nb+Ti) ratio upon fatigue strength and tensile strength at high temperature, from which it is apparent that excellent high-temperature properties are particularly obtained when the ratio of (C+N)/{(Cr−22)+Mo+W+Nb+Ti} is within a range of 0.28–0.46.

Moreover, it has been found that the total amount of Nb and Ti affects the improvement of the high-temperature strength.

Figure 3:
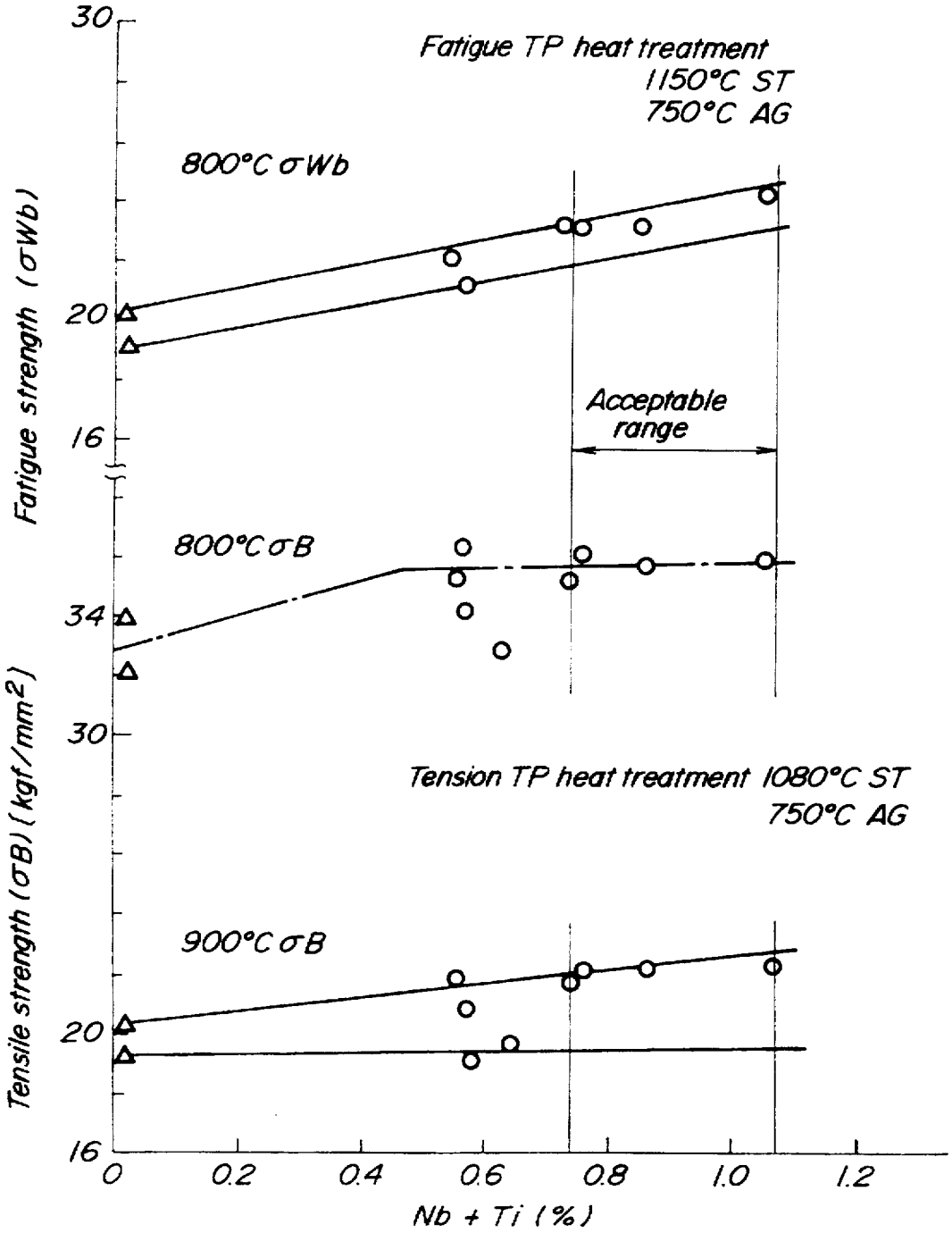
FIG. 3 is a graph showing a relation of (Nb+Ti) amount to fatigue strength and tensile strength at higher temperature.

In FIG. 3 are shown results examined on the influence of (Nb+Ti) amount upon fatigue strength and tensile strength at high temperature.

As seen from FIG. 3, good high-temperature properties are obtained when the (Nb+Ti) amount is within a range of 0.75–1.06 wt %.

The method of producing the steel according to the invention is not particularly restricted. That is, the steel according to the invention may be produced according to usual techniques through melting in an electric furnace in air, composition adjustment, refining, casting into steel ingot, hot working to a given size (forging and rolling) and heat treatment for solid solution.

The following examples are given in illustration of the invention and are not intended as limitations thereof.

Each of ten steels having a chemical composition as shown in Table 1 is produced by melting in an electric furnace, and then subjected to forging, rolling and stress relieving annealing.

In Table 1, Nos. 1–3 are invention steels, and Nos. 4–8 are comparative steels, and Nos. 9 and 10 are JIS SUH35 and 23-8N steel as a conventional steel.

Next, the resulting steel is held at 1080° C. for 20 minutes, subjected to a solid solution heat treatment through water cooling, held at 750° C. for 4 hours and then subjected to an aging treatment through air cooling to obtain a product steel.

The high-temperature strength (tensile, creep and fatigue), corrosion resistance at room and higher temperatures (sulfide, lead oxide) and oxidation increment are measured with respect to the resulting product steels to obtain results as shown in Tables 2 and 3.

TABLE 2-continued

| | No. | Tensile strength at high temperature(*1) 800° C. (kgf/mm²) | Tensile strength at high temperature(*1) 900° C. (kgf/mm²) | Fatigue strength(*2) 800° C. (kgf/mm²) |
|---|---|---|---|---|

(*1)1080° C. × 20 min ST/750° C. × 4 h AG
(*2)1150° C. × 30 min ST/750° C. × 4 h AG
(*3)1177° C. × 30 min ST/750° C. × 16 h AG

TABLE 3

| | No. | PbO corrosion 920° C. (mg/cm²) | Sulfide corrosion 870° C. (mg/cm²) | $CuSo_4$ corrosion 50° C. (inter-granular corrosion μm) | Oxidation increment 900° C. (mg/cm²) |
|---|---|---|---|---|---|
| Invention steel | 1 | 202 | 28.5 | 0 | 1.5 |
| | 2 | 218 | 39.2 | 0 | 1.7 |

TABLE 1

| | Chemical composition (wt %) | | | | | | | | | | | | | | C + N carbonitride | |
|---|---|---|---|---|---|---|---|---|---|---|---|---|---|---|---|---|
| No. | C | Si | Mn | Cr | Ni | Cu | Mo | W | Nb | Ti | N | Al | B | V | forming elements | Remarks |
| 1 | 0.52 | 0.18 | 6.95 | 22.77 | 6.71 | 0.78 | 0.50 | 1.03 | 0.53 | 0.21 | 0.41 | 0.016 | 0.005 | — | 0.037 | Invention steel |
| 2 | 0.53 | 0.24 | 6.99 | 22.75 | 5.14 | 0.87 | 1.05 | 0.44 | 0.60 | 0.24 | 0.44 | 0.016 | 0.004 | — | 0.039 | Invention steel |
| 3 | 0.60 | 0.19 | 6.92 | 22.96 | 5.02 | 0.88 | 1.04 | 0.49 | 0.92 | 0.13 | 0.42 | 0.020 | 0.004 | — | 0.040 | Invention steel |
| 4 | 0.55 | 0.28 | 8.46 | 21.39 | 4.09 | 1.05 | — | 1.02 | 0.32 | 0.25 | 0.44 | 0.015 | 0.006 | 0.30 | 0.043 | Comparative steel |
| 5 | 0.55 | 0.35 | 7.98 | 22.26 | 4.17 | 1.04 | — | 1.00 | 0.48 | 0.27 | 0.37 | 0.012 | 0.004 | — | 0.038 | Comparative steel |
| 6 | 0.52 | 0.20 | 7.36 | 22.94 | 4.57 | 0.90 | 1.09 | 0.48 | 0.36 | 0.20 | 0.40 | 0.018 | 0.005 | 0.37 | 0.036 | Comparative steel |
| 7 | 0.54 | 0.17 | 7.95 | 21.93 | 4.07 | 1.02 | 1.06 | — | 0.32 | 0.23 | 0.42 | 0.013 | 0.005 | 0.30 | 0.040 | Comparative steel |
| 8 | 0.53 | 0.30 | 7.94 | 21.52 | 4.07 | 1.03 | 1.03 | — | 0.44 | 0.18 | 0.40 | 0.020 | 0.006 | — | 0.040 | Comparative steel |
| 9 | 0.54 | 0.10 | 9.00 | 21.30 | 3.50 | 0.10 | — | — | — | — | 0.43 | — | — | — | 0.046 | Conventional steel |
| 10 | 0.36 | 0.64 | 3.31 | 23.27 | 8.15 | 0.14 | — | — | — | — | 0.34 | — | — | — | 0.030 | Conventional steel |

Note:
Carbonitride forming elements are Cr, Mo, W, Nb, Ti and V.

TABLE 2

| | No. | Tensile strength at high temperature(*1) 800° C. (kgf/mm²) | Tensile strength at high temperature(*1) 900° C. (kgf/mm²) | Fatigue strength(*2) 800° C. (kgf/mm²) |
|---|---|---|---|---|
| Invention steel | 1 | 34.8 | 21.5 | 23.0 |
| | 2 | 35.3 | 21.7 | 23.0 |
| | 3 | 35.2 | 22.0 | 24.0 |
| Comparative steel | 4 | 34.0 | 19.0 | — |
| | 5 | 36.0 | 22.0 | 23.0 |
| | 6 | 36.2 | 20.5 | 21.0 |
| | 7 | 35.0 | 21.5 | 22.0 |
| | 8 | 33.0 | 19.5 | — |
| Conventional steel | 9 | 32.0 | 19.0 | 20.0(*3) |
| | 10 | 33.5 | 20.0 | 19.0 |

TP heat treating temperature

TABLE 3-continued

| | No. | PbO corrosion 920° C. (mg/cm²) | Sulfide corrosion 870° C. (mg/cm²) | $CuSo_4$ corrosion 50° C. (inter-granular corrosion μm) | Oxidation increment 900° C. (mg/cm²) |
|---|---|---|---|---|---|
| Comparative steel | 3 | 198 | 38 | 0 | 1.8 |
| | 4 | 293 | 54 | 187 | 3.5 |
| | 5 | 260 | 50 | 130 | 5.0 |
| | 6 | 220 | 38 | 30 | 2.7 |
| | 7 | 198 | 44 | 135 | 4.0 |
| | 8 | 272 | 62 | 98 | 2.5 |
| Conventional steel | 9 | 222 | 73 | 130 | 2.4 |
| | 10 | 270 | 50.5 | 30 | 1.3 |
| Reference example* | | — | 30 ~ 40 | 10 ~ 20 | 1.0 ~ 1.5 |

TABLE 3-continued

| No. | PbO corrosion 920° C. ($mg/cm^2$) | Sulfide corrosion 870° C. ($mg/cm^2$) | $CuSo_4$ corrosion 50° C. (inter-granular corrosion μm) | Oxidation increment 900° C. ($mg/cm^2$) |
|---|---|---|---|---|

*Steel for valve disclosed in JP-A-3-177543
TP size: 8.0 mm × 20.0 mm
Heat treatment: 1080° C. × 20 min ST/750° C. × 4 h AG The above experimental results will concretely be described below.

(1) High-temperature Strength

At first, the tensile strength at high temperatures of 800° C. and 900° C. are measured by a test method as mentioned later. That is, the test is carried out by heating and holding a test piece of JIS Z2201 No. 14A having a diameter of parallel portion of 5 mm to a given temperature for 10 minutes and then pulling it at a strain rate of 3 mm/min.

As shown in Table 2, the invention steels No. 1 to No. 3 are 34–36 $kgf/mm^2$ in the tensile strength at 800° C. and 21–22 $kgf/mm^2$ in the tensile strength at 900° C., respectively, which are improved by about 10–20% as compared with those of conventional steels No. 9 (SUH35) and No. 10 (23-8N steel).

Moreover, all of the comparative steels are greater in strength as compared with the conventional steels. Particularly, the strength of the comparative steels No. 5 and No. 7 is equal to those of the invention steels, which is considered to be largely affected by the balance between the amount of carbonitride forming elements of Cr, Mo, W, Nb, Ti and V and the amount of (C+N).

Next, the fatigue test at 800° C. is carried out with respect to the invention steels, the conventional steels of SUH35 and 23-8N steel and the comparative steels No. 5 to No. 7 by means of Ono's rotating bending test machine.

As shown in Table 2, the fatigue strength at $10^7$ times after the solid solution heat treatment at 1150° C. is 23–24 $kgf/mm^2$ in the invention steels No. 1 to No. 3, while it is 19–20 $kgf/mm^2$ in the conventional steels of SUH35 (after the complete solid solution heat treatment at 1177° C.) and 23-8N steel, so that the fatigue strength is improved by about 15–26% as compared with those of the conventional steels.

On the other hand, the comparative steels No. 5 to No. 7 exhibit a good fatigue strength of 22–23 $kgf/mm^2$, but can not attain a target value of the corrosion resistance as mentioned later.

(2) Corrosion resistance, oxidation resistance

The lead oxide corrosion test, sulfide corrosion test at a high temperature, sulfide corrosion test at room temperature (copper sulfate solution immersion test) and oxidation test are carried out with respect to the invention steels, comparative steels and conventional steels.

The lead oxide corrosion test is a test for corrosion resistance to deposit and melt generated from a combustion product of leaded gasoline on a surface of a valve, in which a ceramic crucible containing 50 g of PbO is heated to 920° C. in a tubular electric furnace to fuse PbO and a test piece of 8 mm in diameter and 20 mm in length is placed therein for 1 hour and then the test piece is taken out from the crucible and washed with an aqueous solution of acetic acid to remove the deposit from the test piece and thereafter the test piece is weighed to measure a weight reduction per unit surface area.

As seen from Table 3, all of the invention steels No. 1 to No. 3 have a weight reduction of 200–220 $mg/cm^2$, which exhibit the corrosion resistance equal to or more than that of the conventional steel SUH35 (220 $mg/cm^2$) and is fairly superior to that of 23-8N steel.

Moreover, the comparative steels No. 4 and No. 5 have a weight reduction of 250–290 $mg/cm^2$ due to higher Si and lower Mo amounts, which are poor as compared with the invention steels, while the comparative steels No. 6 and No. 7 exhibit an excellent result as compared with the conventional steels owing to the effect of lower Si, higher Cr and higher Mo amounts likewise the invention steels.

The sulfide corrosion test at high temperature is a test for the corrosion resistance to high-temperature sulfur-containing corrosion atmosphere generated from a combustion product of a gas oil or the like for diesel engine, in which a test piece is embedded in a synthetic ash of $10CaSO_4$-$6BaSO_4$-$2Na_2SO_4$-1C and held at 870° C. for 80 hours and then the test piece is taken out from the ash and cleaned to measure a corrosion weight loss.

As shown in Table 3, all of the invention steels No. 1 to No. 3 have a corrosion weight loss of 30–40 $mg/cm^2$, which is reduced by half as compared with the conventional steel SUH35 of 70 $mg/cm^2$ and is lower than 23-8N steel of 50 $mg/cm^2$. The corrosion resistance to sulfide at high temperature is improved by adding adequate amounts of Mo, Cu, Ni and Cr.

In all of the comparative steels, it has been confirmed that the corrosion weight loss is reduced by half of SUH35 owing to the addition effect of Cu, which exhibits the similar effect that the corrosion weight loss in steel of JP-A-3-177543 is reduced by half as compared with SUH35 owing to high Ni amount.

The sulfide corrosion test at room temperature is an intergranular corrosion test at a state of rendering sulfur-containing atmosphere from the above combustion product into the vicinity of room temperature and including moisture, in which a half of a test piece is corroded by immersing in Strauss reagent ($H_2SO_4$·$CuCO_4$ solution) warmed at 50° C. for 10 hours and then taken out therefrom to measure a grain boundary corrosion depth in a surface layer of the immersed portion.

As shown in Table 3, the grain boundary corrosion is not observed in the invention steels No. 1 to No. 3, while the corrosion depth is 130 μm in the conventional steel SUH35 and 30 μm in 23-8N steel, from which it is apparent that the effect of improving the resistance to sulfide corrosion at room temperature is developed by adding adequate amounts of Mo, Cu and Ni in the invention.

Moreover, the resistance to sulfide corrosion at room temperature is not improved in the comparative steels because the comparative steels No. 4 and No. 5 contain lower Ni amount and no Mo and the comparative steels No. 7 and No. 8 contain lower Ni and Cu amounts.

The oxidation resistance is important in the steel for exhaust valve because the exhaust valve is subjected to an oxidation at a high temperature due to the rise of combustion temperature accompanied with high thermal efficiency and high power of an engine to thereby degrade high-temperature properties such as strength, corrosion resistance and the like.

The test for oxidation resistance is carried out by heating and holding a test piece of 8 mm in diameter and 20 mm in length in air at 900° C. for 100 hours and then measuring an oxidation increment per surface area.

As shown in Table 3, the oxidation increment in all of the invention steels No. 1 to No. 3 is as small as 1.5–2 $mg/cm^2$, which is near to that of high Ni—Cr 23-8N steel and is smaller than the oxidation increment of SUH35 of 2.4 $mg/cm^2$, from which it has been confirmed that the effect of improving the oxidation resistance is developed by adequately increasing Ni and Cr amounts and decreasing Mn amount.

Moreover, the oxidation resistance in the comparative examples is unattainable compared to those of the invention steels and conventional steels because there is a tendency of decreasing Ni+Cr amounts and increasing Mn amount.

For the reference, the test results on the steel for exhaust valves disclosed in JP-A-3-177543 are also shown in Table 3. As seen from Table 3, the resistance to sulfide corrosion at high temperature and oxidation resistance are equal to those of the invention steels, but the resistance to sulfide corrosion at room temperature is poor as compared with those of the invention steels.

As mentioned above, according to the invention, there can be provided steels for exhaust valves very useful as a material for high-performance engines having not only excellent fatigue strength, corrosion resistance and oxidation resistance at higher temperature but also excellent corrosion resistance at room temperature and being cheap.

What is claimed is:

1. A steel for exhaust valves having excellent fatigue strength at a high temperature, corrosion resistance at room and higher temperatures and oxidation resistance, comprising C: 0.50–0.65 wt %, Si: 0.1–0.3 wt %, Mn: 5.0–8.0 wt %, Cr: 22.0–24.0 wt %, Ni: 5.0–7.0 wt %, Cu:0.4–1.0 wt %, Mo: 0.4–2.0 wt %, W: 0.4–2.0 wt %, Nb: 0.4–2.0 wt5, Ti: 0.1–0.3 wt %, N: 0.35–0.50 wt %, sol. Al: 0.005–0.03 wt %, B: 0.001–0.01 wt %, provided that (Cu+Ni): 5.8–7.6 wt %, balance essentially Fe.

2. A steel for exhaust valve according to claim 1, wherein said steel has a ratio of C+N to carbonitride forming elements of Cr, Mo, W, Nb and Ti satisfying the following relationship:

$$(C+N)/\{(Cr-22)+Mo+W+Nb+Ti\}=0.28-0.46.$$

3. A steel for exhaust valve according to claim 1, wherein a total amount of Nb and Ti is within a range of 0.75–1.06 wt %.

* * * * *